United States Patent [19]

Grellier

[11] 4,063,688

[45] Dec. 20, 1977

[54] TEXTILE YARN CARRIER

[75] Inventor: René Grellier, Valence, France

[73] Assignee: Rhone-Poulenc-Textile, Paris, France

[21] Appl. No.: 546,666

[22] Filed: Feb. 3, 1975

[30] Foreign Application Priority Data

Mar. 18, 1974 France ..... 74.09385

[51] Int. Cl.[2] ..... B65H 54/40; B65H 75/18

[52] U.S. Cl. ..... 242/18 DD; 242/118.3; 242/178

[58] Field of Search ..... 242/18 DD, 18 R, 18 G, 242/43, 118, 118.1, 118.11, 118.2, 118.3, 118.31, 118.32, 159, 172, 174, 175, 176, 177, 178

[56] References Cited

U.S. PATENT DOCUMENTS

| | | | |
|---|---|---|---|
| 1,588,259 | 6/1926 | Morrell | 242/176 X |
| 2,980,354 | 4/1961 | Mason | 242/176 X |
| 3,158,335 | 11/1964 | Deussen | 242/118.3 X |
| 3,291,405 | 12/1966 | O'Brien | 242/18 DD |
| 3,701,490 | 10/1972 | Wray | 242/18 DD |
| 3,830,439 | 8/1974 | Porter | 242/18 DD |

FOREIGN PATENT DOCUMENTS

| | | | |
|---|---|---|---|
| 1,099,935 | 1/1968 | United Kingdom | 242/18 DD |

*Primary Examiner*—Stanley N. Gilreath
*Attorney, Agent, or Firm*—Sherman & Shalloway

[57] ABSTRACT

A yarn carrier especially for use with packages of pre-oriented yarn has a pair of grooves therein which accommodate extra thicknesses of yarn which accumulate at areas on the carrier where reversal of the yarn takes place. Engagement of these thicknesses by a winding roll does not result in faults in the yarn because the thicknesses are urged by the winding roll into the grooves.

8 Claims, 5 Drawing Figures

TEXTILE YARN CARRIER

BACKGROUND OF THE INVENTION

1. Field of the Invention

This invention relates to textile yarn carriers. More particularly, this invention relates to tubes used for high speed winding of pre-oriented thermoplastic textile yarns. For the purposes of this invention, "pre-oriented yarns" are yarns of which the molecular orientation is not complete and which have a residual draw ratio wherein drawing is completed during a subsequent continuous or discontinuous process.

2. Technical Considerations and Prior Art

The process of spinning and partially drawing polyester yarns continuously is known. These yarns are wound in a pre-oriented state with a residual draw ratio which varies from 1.4 to 2. Drawing to a standard draw ratio (about 4) is completed, for example, during texturing.

However, one is faced with problems when winding pre-oriented yarns with a tangential drive onto winding packages with a winding roll. These problems are more pronounced at the beginning of the winding operation. The winding roll is designed to control the package winding speed, while completely or partly supplying the moment necessary for driving it. The winding roll is also provided with two over thicknesses which act as start-up rings and exhibit a 0.1 to 1 mm diameter in excess of the other parts of the winding roll. These rings are positioned on the winding roll at locations corresponding to the tube end areas and outside of the package winding area.

One purpose of the start-up rings is to confer an overspeed to the winding tube in order that, upon starting, the yarn winds up onto the tube rather than onto the winding roll. The tube is held by a device such as a stirrup provided with small discs holding it by its extremities, or by a spindle traversing its whole length and driving it in rotation. This last solution may be selected in high speed windings, that is, of 6,000 – 7,000 meters/-minute or more.

The yarn is distributed along the tube by a traversing device. In spite of all of the precautions which are taken on building traversing devices, the yarn distribution is not strictly uniform along the entire length of the tube because there is an excess accumulation of material in the zone where the traversing devices reverse. In both the reversal zones at both ends of the tube, the yarn speed is not constant, but decreases, then is null, and after reversal, increases again up to its nominal value. The material accumulation at reversal points produces overthicknesses or "incipient projections". One purpose of the driving roll is to compress these projections in order that the winding package generatrix may be nearly rectilinear. When the winding up operation starts, the tube is in contact with the rings and the package does not touch the driving roll. However, the package grows and at both ends forms incipient projections which, at a given time, come into contact with the driving roll.

It has been observed that contact between package ends and the winding roll could prejudicially effect pre-oriented yarns in the following ways:

a. At the top of the projections, the yarn is overspeed in relation to the winding roll. This overspeed depending on the dimensions of the driving roll and the winding package tube may be about 1.5%. For a winding speed of 3,000 m/min, this overspeed is about 45 m/min, which is not negligible. Therefore, when the projections come into contact with the driving roll, there is a slippage of 45 m/min which applies to short lengths of pre-oriented yarn.

b. When a cardboard tube is used as a winding package tube, its geometrical characteristics frequently vary. Consequently, the tube may exhibit faults due to inaccurate centering which, on rotation, produces vibrations which impact on the package on the winding roll.

When using a prior art tube, the pre-oriented yarn on contacting the winding roll is submitted to the above-cited effects *a* and *b* at the level of the incipient projections. It is subjected at these locations to strains which, at the reversal points, produce an impact which overdraws portions of the yarn about one centimeter long. Thus, after winding, this yarn exhibits length fractions of different molecular orientation which, on the last drawing operation (for example, on simultaneous draw-texturing) will produce under-drawn lengths. These under-drawn lengths produce faulty yarns with respect to count and dyeing, which are treated in an aleatory manner in commercial production, according to the quality of the winding tube used. This fault is currently referred to as "bobbin inner end fault".

It has been observed that when a tube is mounted on a spindle traversing its whole length, there is a point where the fault repeats itself more markedly with a periodicity corresponding to the reciprocating travel of the traversing guide. The more marked fault corresponds to the reversal point situated at the back part of the spindle (by "back" is meant the part of the spindle situated on the side of its fixation on the winder frame). The forepart of the spindle is far from the fixation and exhibits higher flexibility, thus allowing strains to be absorbed. Since the back part of the spindle is more rigid than the forepart, the yarn absorbs these strains, which causes deformation of the yarn.

To solve the problem of "bobbin inner end fault", reducing the pressure of the tube against the winding roll at the beginning of the winding operation was tried. Thus, a usual force of 40 to 50 N was reduced from 10 to 20 N during the first winding phase. Such a process, however, if it reduces faults, it does not eliminate faults totally.

OBJECTS OF THE INVENTION

It is, therefore, an object of this invention to provide a new and improved textile yarn carrier which avoids the above-mentioned difficulties.

It is an additional object of this invention to provide a new and improved textile yarn carrier which may be used with winding machines having a winding roll while avoiding deleterious effects of the winding roll on pre-oriented yarn where the yarn is reversed on the carrier.

It is still another object of this invention to wind pre-oriented yarn on a yarn carrier without introducing periodic faults in the yarn.

It is a further object of the instant invention to provide a new and improved yarn carrier which has grooves to accommodate extra thicknesses of yarn accumulated during reversal of the yarn as the yarn is distributed on the carrier.

SUMMARY OF THE INVENTION

This invention relates to tubular carriers of textile yarn packages particularly used with winding machines which comprise a winding roll in tangential contact with a winding package and which are provided with at least one starting ring having a diameter greater than that of the winding roll. The starting ring is designed to frictionally drive said carrier at the beginning of the winding operation. On the external surface of the carrier, there are two circular depressions situated in the areas corresponding to the reversal points, said depressions being at least as deep as the overthickness of the starting ring. These depressions are made on the tubular carrier or tube in the form of grooves. The bottom of the depressions may have a flat or curved profile. The connection of the depression bottom with the external surface of the carrier is smooth without a sharp angle and is a chamfered, hollow curvature edge. The depression width depends on the yarn overthickness width at the reversal points. In the case of current size tubes having a 75 mm outside diameter, driven by a winding roll provided with starting rings having a diameter of 0.8 higher than that of the winding roll body, these depressions advantageously are 5 to 15 mm wide and 0.4 to 0.8 mm deep.

At the beginning of a winding operation, yarn overthicknesses or ribbons, at the reversal points, form at the level of depressions and, thus, are no more prominent in relation to the median part of the winding package than the yarn winding itself. Therefore, the winding package-winding roll contact is carried out on nearly the whole length of the package. The contact impact is now distributed on the whole length of the package and no more affects only the ends. Consequently, there is no more deformation of pre-oriented yarns at the reversal points, and yarn structure is uniform over the whole length of the carrier. Further drawing will, therefore, not produce under-drawn zones or lengths.

The tubes may be cylindrical or conical. They are made from usual winding tube matrials, such as relatively soft and deformable materials, cardboard and some plastics. As explained in the preamble, it often happens that such tubes made from soft materials do not exhibit perfect geometrical characteristics, which causes prejudicial effects and faulty yarns. In this case, the depression role is primarily to eliminate faults. This invention is, therefore, of greatest interest with respect to such materials.

Tubes may also be made from rigid materials, such as metal or metallic alloys. Such tubes compared to cardboard tubes exhibit improved geometrical characteristics, and the risk of producing the above-mentioned faults is reduced. However, it is still advantageous to provide these tubes with depressions according to the teachings of this invention.

Advantageously, depressions are made on the tube when it is manufactured. In the case of cardboard tubes, they can be made by pin-punching with a grooved wheel. In the case of metal tubes, the same pin-punching technique may be used, or a groove may be made by removing material. The tube thickness, of course, should be sufficient to prevent depressions from adversely affecting its mechanical strength.

The following examples and figures are presented hereinafter to illustrate the invention; however, the invention is not restricted thereby.

DESCRIPTION OF THE PREFERRED EMBODIMENTS

Prior Art

Figure 1:
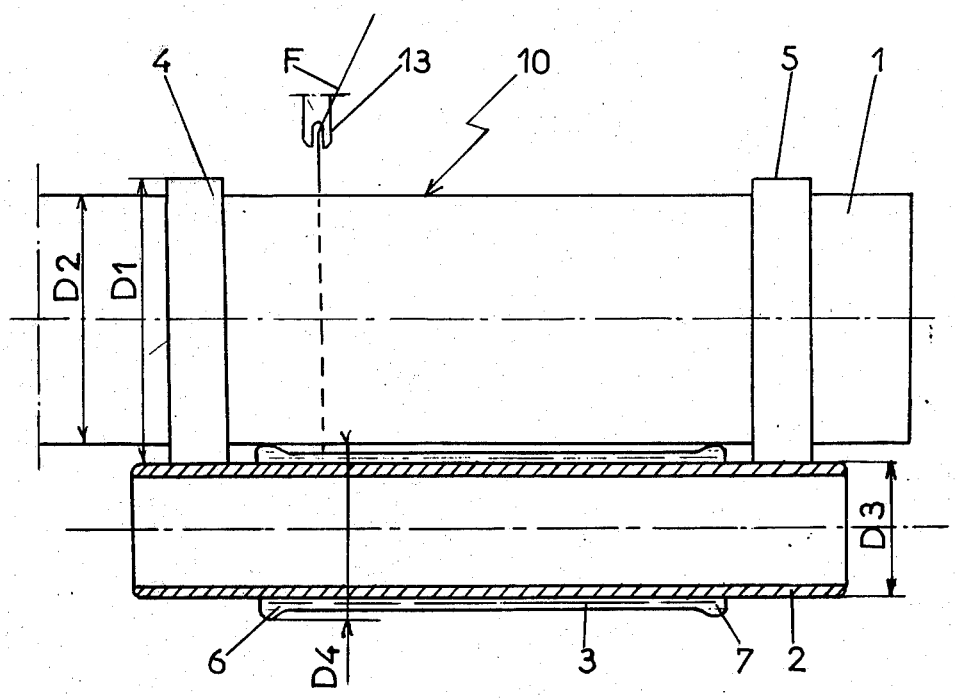
FIG. 1 PRIOR ART
FIGS. 1 and 2 illustrate yarn winding apparatus with a conventional tube according to the prior art.

FIG. 1 schematically illustrates the main components of a winding station, namely a winding roll 1, a winding tube 2 in tangential contact with the winding roll, and a yarn traversing guide 13. At the beginning of a winding operation, the tube winding roll contact occurs at the level of start-up rings 4 and 5 (the overthickness of rings 4 and 5 is very magnified to make the figure clearer). This contact continues until the winding package 3 has reached a diameter sufficient to allow it to come into contact with the median part 10 of the winding roll. The resulting winding package-driving roll contact continues until the tube winding is completed. The winding package begins to come into contact with the winding roll at the level of the "incipient projections" 6 and 7 which are situated at the reversal points, thereby leading to the above-mentioned prejudicial effects and faulty yarns.

Figure 2:
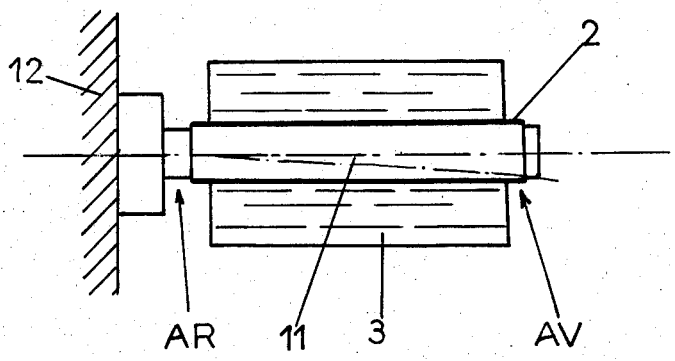
FIG. 2 PRIOR ART

FIG. 2 illustrates a spindle 11 on which tube 2 is mounted. The spindle is secured at one end to the frame 12. It has been observed that faults more frequently occur on parts corresponding to the back reversal point AR where flexibility is lower than the flexibility at the front reversal point AV.

Embodiments of the Present Invention

Figure 3:
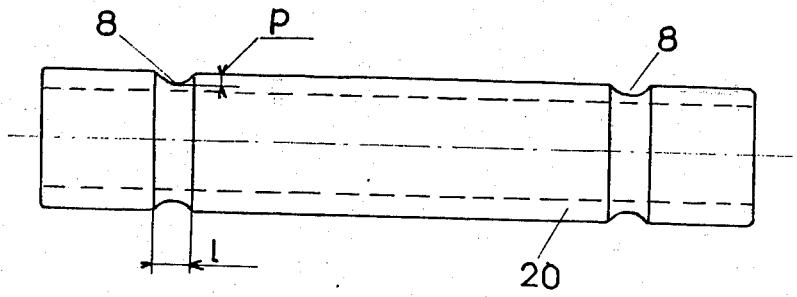
FIG. 3 illustrates a winding tube according to the instant invention.

FIG. 3 illustrates a cardboard tube 20 according to the instant invention provided with two depressions 8 formed at the reversal points. These depressions consist of two grooves, the bottom of each having a curved profile made in the tube by milling during manufacture. For a conventional tube having a 75 mm outside diameter, driven by a windng roll which is 160 mm in diameter provided with starting rings 160.8 mm in diameter, the depth $p$ of grooves 8 is advantageously between 0.4 and 0.8 mm and the width $l$ of said grooves is between 5 and 15 mm. Generally, a width between 5 and 10 mm is sufficient.

Figure 4:
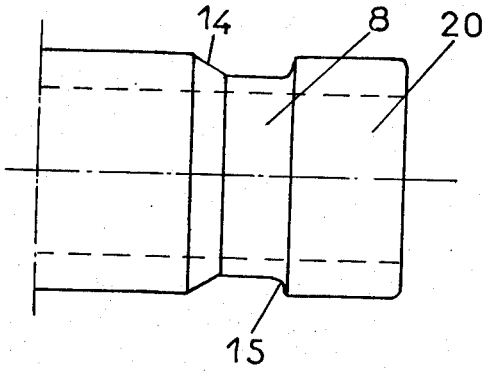
FIG. 4 illustrates a second embodiment of a winding tube according to the instant invention.

FIG. 4 is a partial view of a tube according to the instant invention which is provided with depressions 8 of which a flat bottom is connected to the outside surface of the tube on the one side by a chamfer 14 and on the other side by a hollow curvature 15.

Figure 5:
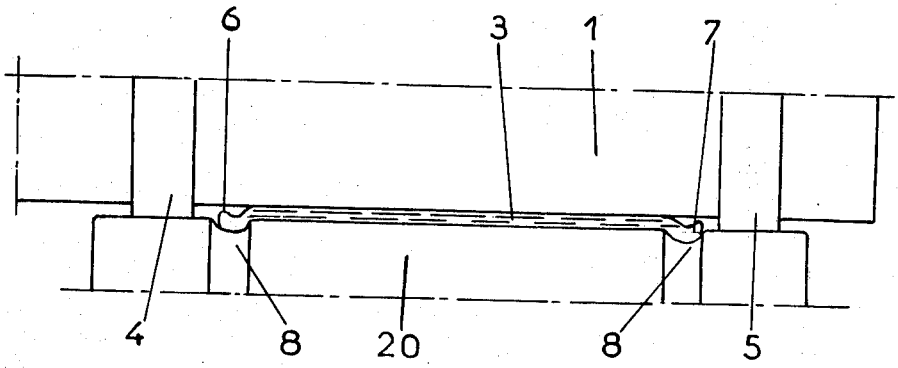
FIG. 5 illustrates a first phase of the winding process utilizing a tube according to the instant invention.

FIG. 5 shows the tube according to FIG. 3 during a winding operation. In this figure, the package 3 has reached the diameter sufficient to allow it to come into contact with the median part 10 of the winding roll 1. The contact of rings 4 and 5 with tube 20 is about to terminate. The yarn overthicknesses (incipient projections) 6 and 7 are formed in depressions 8, and are set back from the level of package median part 3. The contact of the package with the winding roll 1 occurs on the major part of the package 3 and not only at the incipient projections 6 and 7. The yarn is thereby saved from damage.

Comparative tests were carried out with prior art carriers and with carriers according to the instant invention as illustrated in FIGS. 3–5. These tests are illustrated by, but not limited to, the following examples.

EXAMPLE 1

In this example, winding was carried out with a prior art carrier.

On a winder type such as illustrated in FIG. 1, a 167 dtex/30 filament pre-oriented polyester yarn was wound on a conventional cardboard tube. Winding conditions were as follows:

| | |
|---|---|
| winding speed | 3600 m/min |
| residual draw ratio | 1.6 |
| winding roll diameter | 160 mm |
| start-up ring diameter | 160.8 mm |
| tube outside diameter | 75 mm |
| pressing force of tube against winding roll | 30 N. |

The regularity of said "bobbin inner end" fraction of yarn, that is, taken among the first layers wound when the tube is in contact with the winding roll through its start-up rings, was monitored by an USTER regularimeter.

The yarn in this example showed periodical irregularities which were very perceptible. About thirty irequalarities per ten centimeters were found. In other words, 100 meters of yarn showed thirty irregularities.

EXAMPLE 2

A carrier from the instant invention was utilized.

Two depressions 10 mm wide and 0.6 mm deep, such as those shown in FIGS. 3–5, are made on the tube. The so modified tube is mounted at the same winding position as in Example 1; the same yarn is wound under identical winding conditions.

The yarn "bobbin inner end" fraction is monitored in the same way as in the previous example with an USTER regularimeter. In this example, no irregularities were found.

EXAMPLE 3

Thirty packages were wound on tubes designed according to the instant invention. The "bobbin inner end" fraction of yarn of the thirty packages was monitored with the regularimeter. No irregularities were observed. When using prior art tubes, however, an average of one faulty package out of seven to eight packages occurs.

EXAMPLE 4

Yarns from the thirty packages were dyed, then knitted. On knit goods, no faulty dyeing was observed, whereas yarns wound on prior art carriers exhibit irregularities characterized by overdyed areas.

The afore-cited examples show the usefulness of this invention, which obviates the problems of the "bobbin inner end" fraction of yarn and consequent yarn waste.

Through the invention is particularly adapted to the pre-oriented yarn winding, it may be used for winding yarns of any type, any nature and any count.

I claim:

1. A tubular carrier for a textile yarn winding package, wherein the tubular carrier has a package winding area along its length and is used with a winding machine which includes a winding roll for tangential contact with the package, and wherein the winding roll has a start-up ring extending therearound generally in a plane normal to the axis of the winding roll, said ring having a diameter greater than the diameter of the roll, so that the outer surface of the ring extends beyond the outer surface of the roll, and being axially displaced from the package winding area, the winding machine further including a traversing mechanism for distributing yarn on the roll; the improvement comprising:

a pair of circular grooves around the periphery of the carrier at the areas corresponding to reversals of the traversing mechanism, said grooves having a depth at least as great as the thickness of the start-up ring.

2. The carrier according to claim 1 in which the grooves are 5 to 15 mm wide and 0.4 to 0.8 mm deep.

3. The carrier according to claim 2, wherein each groove has a flat bottom.

4. The carrier according to claim 1, wherein each groove has a flat bottom.

5. The carrier according to claim 1 in which each groove has a concave, curved bottom.

6. The carrier according to claim 2, wherein each groove has a concave, curved bottom.

7. The carrier according to claim 5, wherein the bottoms of the grooves are joined to the surface of the carrier with a smooth, arcuate portion.

8. The carrier according to claim 6, wherein the bottoms of the grooves are joined to the surface of the carrier with a smooth, arcuate portion.

* * * * *